United States Patent [19]

Bumgardner et al.

[11] Patent Number: 4,561,130

[45] Date of Patent: Dec. 31, 1985

[54] TOILET SEAT COVER SAFETY LATCH

[76] Inventors: Dewey Bumgardner, 256 Country Club Dr.; Julian Marple, Jr., 19R Jackson Ave., both of Winchester, Va. 22601

[21] Appl. No.: 617,556

[22] Filed: Jun. 5, 1984

[51] Int. Cl.[4] ..... A47K 13/00

[52] U.S. Cl. ..... 4/253; 4/236; 4/240; 4/661; 16/320; 16/323

[58] Field of Search ..... 4/234, 252, 253, 661, 4/236, 240; 16/323, 319, 324, 337, 338, 320, 341; 292/251.5, 358

[56] References Cited

U.S. PATENT DOCUMENTS

| | | | |
|---|---|---|---|
| 2,651,053 | 9/1953 | Rowe et al. | 4/253 |
| 2,692,394 | 10/1954 | Paulus | 4/234 |
| 3,016,563 | 1/1962 | DeJong | 16/320 |
| 3,351,976 | 11/1967 | Gionet | 16/323 |
| 3,388,418 | 6/1968 | Bey | 16/320 |
| 3,426,386 | 2/1969 | Wise | 16/323 |
| 3,562,850 | 2/1971 | Eliason et al. | 16/320 |

FOREIGN PATENT DOCUMENTS

| | | | |
|---|---|---|---|
| 1530591 | 11/1978 | United Kingdom | 16/320 |

*Primary Examiner*—Henry K. Artis
*Attorney, Agent, or Firm*—Wigman & Cohen

[57] ABSTRACT

A hinge mechanism for controlling the operation of a toilet seat cover comprising a base, two pairs of linkages and a cover engaging element. An adjusting bolt and spring provide a structure for adjusting the alignment of the linkages. When the linkages are below their axes of alignment, the adjusting bolt interacts with the base to provide resistance to the opening of the seat cover. An alternative embodiment incorporates magnets on the seat cover and the toilet bowl and relies on the repelling force of the magnets to resist the opening of the seat cover.

9 Claims, 6 Drawing Figures

TOILET SEAT COVER SAFETY LATCH

BACKGROUND OF THE INVENTION

The present invention relates to a safety device for controlling the operation of a toilet seat and cover, and, more particularly, to an adjustable device for making it difficult for small children to lift a toilet seat cover.

Open or easily accessible toilets present potential problems when infants and small children are present. It is a common occurrence for small children to throw various articles into the toilet bowl which may be lost and/or obstruct the discharge line. It is also unfortunately the case that a large number of infants actually drown in toilets each year.

A few devices are known in the prior art for controlling the operation of toilet seats and covers. For example, U.S. Pat. No. 2,692,394 discloses a lavatory attachment comprising a spring means that is used to restrain the lifting of a toilet seat cover. However, that device is unsatisfactory because the restraining force is not adjustable and the device is not readily disengageable.

SUMMARY AND OBJECTS OF THE INVENTION

In view of the foregoing limitations and shortcomings of the prior art devices, as well as other disadvantages not specifically mentioned above, it should be apparent that there still exists a need in the art for a convenient and simple device for controlling the operation of a toilet seat cover. It is therefore, a primary objective of this invention to fulfill that need by providing a simple and easily adjustable device for limiting the raising of a toilet seat cover, especially by small children.

More particularly, it is an object of this invention to provide an attachment for a conventional toilet seat and cover that can prevent young children from raising the cover.

It is a further object of this invention to provide a safety latch device for a toilet seat cover that incorporates an easily adjustable resistance to the opening of the cover.

It is yet another object of this invention to provide a safety latch device that incorporates an adjustable resistance to the opening of a toilet seat cover wherein the resistance can be reduced to a negligible level without removing the device.

Briefly described, the aforementioned objects are accomplished according to the invention by providing a hinge assembly that attaches to the back side of a toilet seat cover. The hinge assembly includes a pair of interconnected overcenter toggle linkages connected together by a center pivot pin between a fixed base portion and a toilet seat cover engaging element. A spring applies a downward bias to the center pivot pin of each toggle linkage, and an adjusting bolt cooperates with the linkages for adjusting the alignment of the linkages and the opening resistance of the cover.

As used in the specification and claims herein, the term "dead center alignment" is intended to refer to the position of the linkages wherein the longitudinal axes of the linkage elements are in coincidental alignment.

When the linkages are adjusted by the bolt such that the longitudinal axes of the linkage elements are about 5° above dead center alignment, the linkages are caused to pivot upwardly with minimal resistance when the seat cover is raised. If the linkages are adjusted to a position where the longitudinal axes of the linkage elements are only slightly above dead center alignment, i.e., ½° to 1°, then the seat cover is more difficult to open. When the linkages are aligned such that the axes of the linkage elements are at or below dead center, then the device prevents the cover from being lifted at all because the hinge arrangement deflects the linkages downwardly, and the adjusting bolt contacts the base, preventing further downward movement of the linkages.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
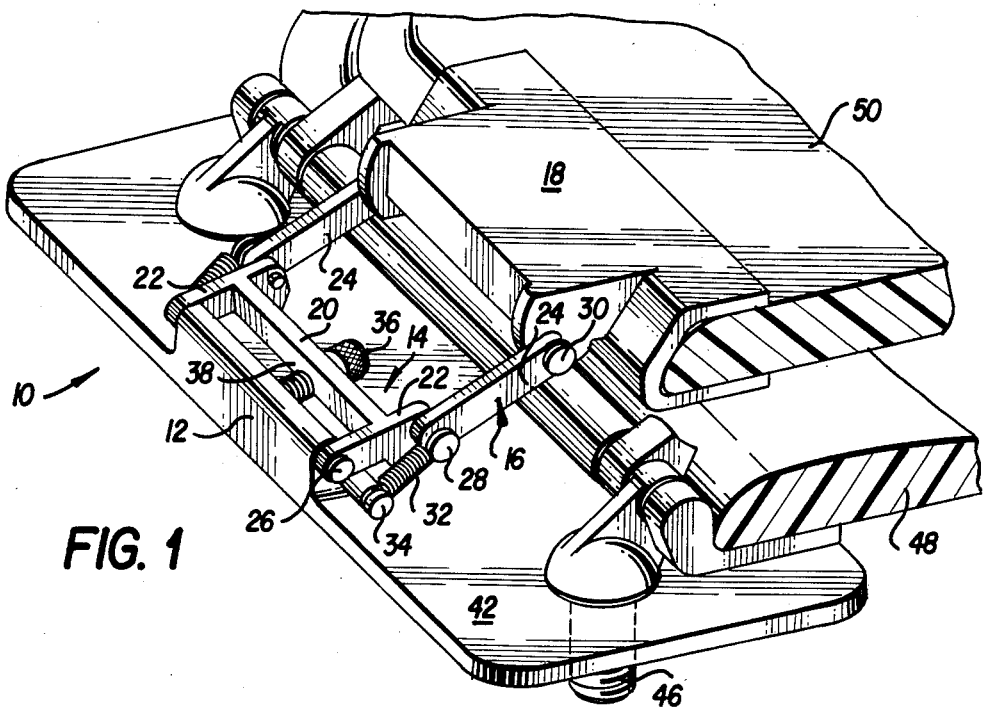
FIG. 1 is a perspective view of the hinge assembly of the present invention shown mounted on a standard toilet seat cover.
Figure 2:
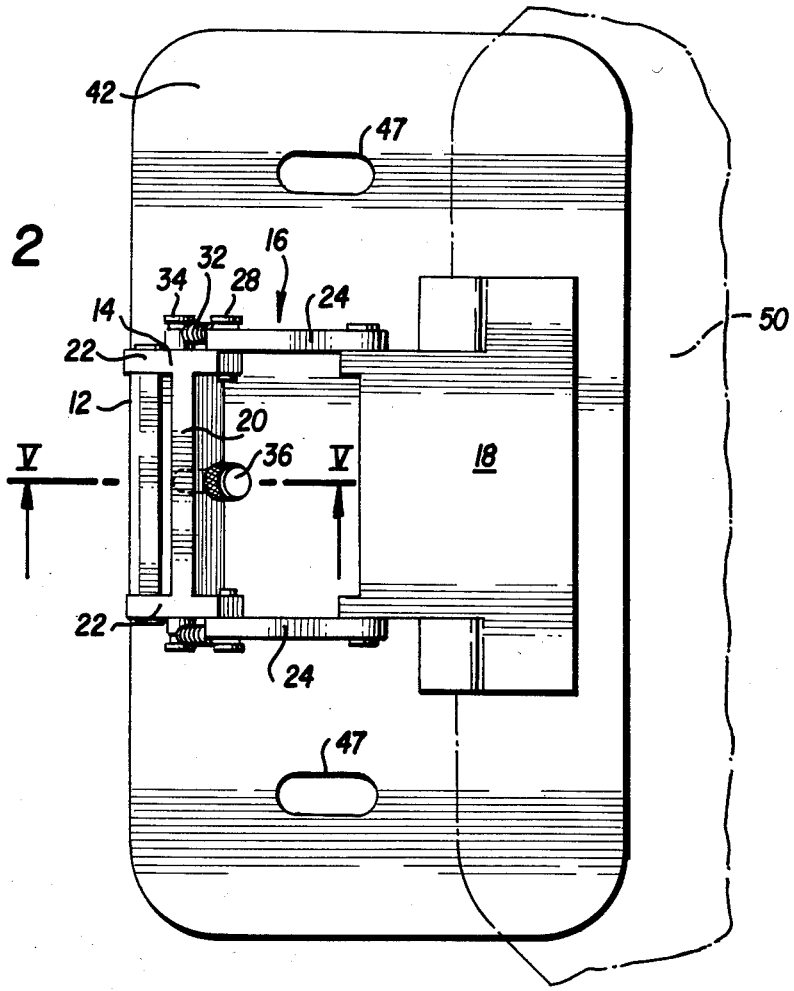
FIG. 2 is a top plan view of the hinge assembly.

Referring now in detail to the drawings wherein like parts are designated by like reference numerals throughout, there is illustrated in FIG. 1, a hinge assembly for a toilet seat cover which is designated generally by reference numeral 10. The hinge assembly is mounted at one end to the toilet seat cover and at the other end thereof to the top surface of the rim of the toilet bowl by conventional fastening means. The hinge assembly 10 is designed to selectively control pivotal movement of the seat cover and/or the seat itself and can be adjusted such that minimal resistance is applied to the lifting of the seat cover, or maximum resistance is applied so that the cover is prevented from being lifted at all. As described hereinafter, the hinge assembly 10 can also be adjusted to provide various degrees of resistance to lifting of the cover.

The hinge assembly 10 comprises a base portion 12, a lower linkage 14, an upper linkage 16, and a cover engaging element 18, each made preferably from a tough plastic material, such as Dupont's ST801 nylon.

Figure 5:
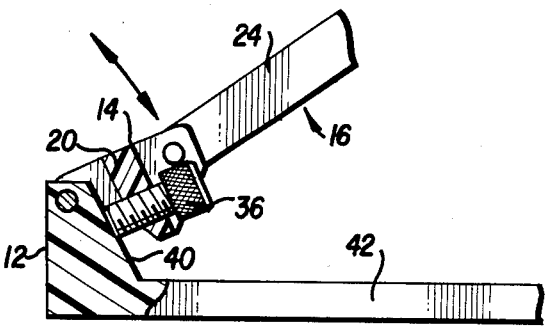
FIG. 5 is a cross-sectional view of the hinge assembly taken along line V—V of FIG. 2.

The base 12 of the hinge assembly 10 includes a flat plate 42 as best seen in FIGS. 1 and 5. The plate 42 is mounted to the top surface of the rim of a conventional toilet bowl at the backside thereof by passing cover mounting bolts 46 through slotted openings 47 in the plate 42.

Figure 3:
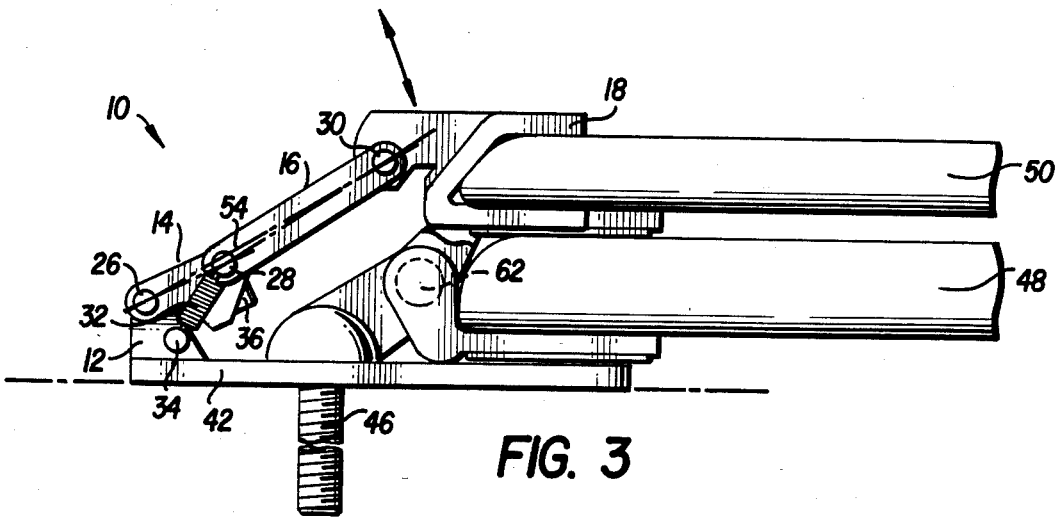
FIG. 3 is a side elevation view of the hinge assembly with the seat cover closed.
Figure 4:
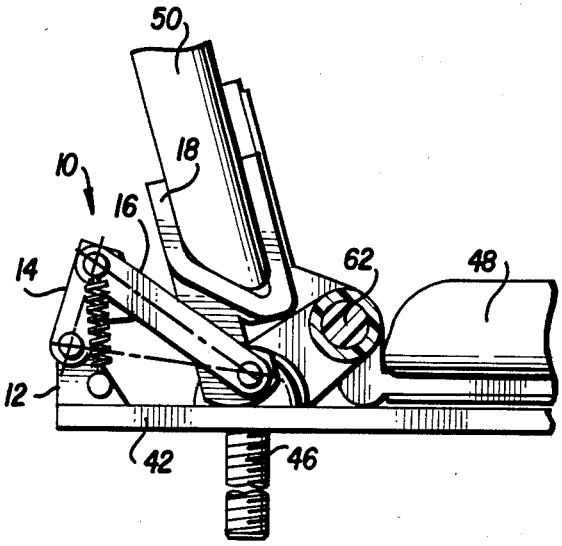
FIG. 4 is a side elevation view of the hinge assembly with the seat cover open.

The cover 50 and seat 48 are mounted for pivotal movement about the axis of a shaft 62 in a conventional manner. The cover engaging element 18 of the hinge assembly 10 is generally U-shaped at one end and is adapted to grippingly engage the toilet seat cover 50 as seen in FIGS. 1 and 3.

The lower linkage 14 comprises a transverse crosspiece 20 integrally formed with side arms or links 22.

The upper linkage 16 comprises two separate arms or links 24, each of which is connected to a respective link 22 of the lower linkage 14 so as to form a pair of over-center toggle linkages. The four elements 12, 14, 16, 18 are pivotably interconnected end-to-end by snap-over mushrooms, bolts, rivets, or other suitable pivot means 26, 28, 30.

The toggle pivot pins 28 interconnecting the upper and lower linkages 16, 14 extend slightly beyond the linkages so that springs 32 may be connected between the pins 28 and posts 34 protruding from base 12 on each side of the linkages. As is apparent from FIGS. 1 and 3, the spring 32 is arranged to apply a downward bias to the toggle linkages.

A finely threaded adjusting bolt 36 is mounted in a threaded bore 38 in crosspiece 20 and abuts against a flat inclined surface 40 of the base 12. See FIG. 5. The bolt 36 supports the toggle linkages 14, 16 against the downward bias of the spring 32 and can be adjusted to vary the alignment of the longitudinal axes of the linkages 14, 16.

With the hinge assembly mounted as above described, the lifting of the seat cover 50 causes the cover engaging element 18 to move in an arcuate path about the axis of shaft 62, as shown by the arrow in FIG. 3. This movement causes the toggle linkages to "break" at the center pivot 28 such that the upper and lower linkages 16, 14 fold toward each other.

When the linkages 14, 16 are adjusted by the adjusting bolt 36 such that the longitudinal axes of the links 22, 24 lie below the dead center alignment position, which is represented by line or axis 54 passing through the centers of pivot pins 26 and 30 (see FIG. 3), the linkages 14, 16 will attempt to pivot downwardly below the dead center alignment position as the cover 50 is raised. However, since the free end of adjusting bolt 36 abuts against the inclined surface 40 of base 12 the linkages 14, 16 are prevented from pivoting significantly downwardly below the dead center alignment position and thus the cover 50 is prevented from being raised. FIG. 5 shows the bolt 36 in abutment against surface 40 of base 12 with the toggle linkage in the "locked" position.

If the adjusting bolt 36 is set such that the longitudinal axes of the linkages are only slightly above line 54, e.g., by less than about 2°, when the cover is in the lowered position, then the forces exerted on the linkages 14, 16 by the lifting of the cover are compressive forces directed primarily longitudinally along the axes of the linkages. Those forces tend to frictionally bind the linkages against the pivot pin 28 resulting in substantial resistance to the lifting of the cover. The closer the longitudinal axes of the linkages are to the dead center alignment position of line 54, the greater the resistance to the lifting of the cover. If the linkage axes are more than a few degrees above the dead center alignment position of line 54, then cover lifting forces exerted on the linkages have a lesser longitudinal compressive component resulting in less friction and a greater component perpendicular to the longitudinal axes. The perpendicular component allows the linkages to pivot upwardly toward each other and allows the cover to be lifted with minimal resistance. Thus, the resistance to lifting the cover can be easily adjusted by bolt 36.

Figure 6:
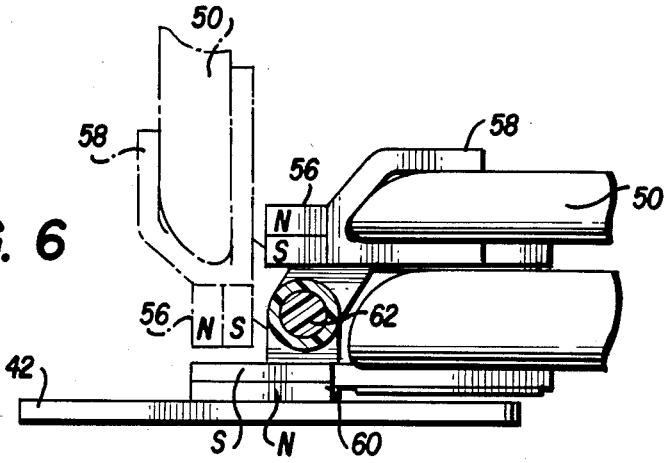
FIG. 6 is a side elevation view of an alternative embodiment of the present invention.

An alternative embodiment of the present invention utilizes magnets instead of the linkages to resist the lifting of the seat cover and is illustrated in FIG. 6. A magnetic element 56, which may be about 3½ inches wide, i.e., in transverse dimension across the back of seat 50, is mounted on the rear of seat cover 50 by means of a cover engaging element 58. A corresponding magnet 60 of a width similar to that of magnet 56 is mounted on base 42 below the seat hinge 62 between bolts 46.

The magnets 56, 60 are polarized across their respective thicknesses and are oriented with like poles in confronting relation, for instance, with south poles confronting one another as shown in FIG. 6. Thus, there is a repelling force, preferably of about 40 pounds, between the magnets which tends to resist the lifting of the cover 50, because the pivoting action of the cover positions the magnets closer to each other. However, once the cover is lifted, the magnet 56 on the cover is oriented generally at right angles to magnet 60, as seen in the broken lines of FIG. 6. In the raised position, the repelling force between the like south poles is substantially balanced or equalized by the attractive force between the opposite poles, i.e., north pole of magnet 56 and south pole of magnet 60. It will be apparent that continued pivoting of the cover 50 will result in a greater attractive force between magnets 56, 60. The initial resisting force of the magnets is sufficiently great to prevent a small child from lifting the cover, but is easily overcome by an adult.

Although only preferred embodiments are specifically illustrated and described herein, it will be appreciated that many modifications and variations of the present invention are possible in light of the above teachings and within the purview of the appended claims without departing from the spirit and intended scope of the invention.

We claim:

1. A safety latch for providing resistance to the opening of a toilet seat cover for a toilet bowl, comprising:

a cover engaging element mounted to the back side of a toilet seat cover;

a base fixed to the toilet bowl;

linkage means interconnecting said cover engaging element and said base for providing resistance to the lifting of the toilet seat cover; and means for adjusting the magnitude of lifting resistance provided by said linkage means.

2. The device of claim 1, wherein said linkage means comprise two parallel pairs of toggle links mounted on opposite sides of said base, the two links connected to said base being interconnected by a crosspiece.

3. The device of claim 2, wherein the adjustment means is mounted through the crosspiece and abutting said base for adjusting the alignment of the links to thereby adjust the magnitude of lifting resistance.

4. The device of claim 3, further comprising a means for applying a downward bias on said linkages.

5. A safety latch for a hinged cover, comprising:

a cover engaging element mounted to the hinged side of the cover;

a base fixed to a surface adjacent the hinge of the cover;

first and second toggle linkages interconnecting said cover engaging element and said base, said first linkages comprising two parallel links interconnected by a transverse crosspiece, said second linkages comprising parallel links interconnected between the first linkages and the cover engaging element by pivot pins;

adjustment means mounted in said crosspiece and abutting against said base for adjusting the position of the longitudinal axes of the links and thereby the resistance to lifting the cover is dependent upon the adjustment of the axes of the links.

6. A safety latch for providing resistance to the opening of a toilet seat cover for a toilet bowl comprising magnet means for providing resistance to the opening of the cover; said magnet means including:

a first magnet engaged with the toilet seat cover and a second magnet mounted adjacent the first magnet with like poles in confronting relationship when said seat is in the closed position;

wherein the repulsive force between the magnets provides the resistances to the opening of the cover.

7. The device of claim 6, wherein the pivot of the seat cover is located between the seat cover and the first magnet such that the first magnet is lowered toward the second magnet when the seat cover is raised.

8. The device of claim 6, wherein the first magnet and second magnet are arranged such that the first magnet is partially inverted with respect to the second magnet when the seat cover is raised such that both poles of the first magnet are in equal proximity to one pole of the second magnet.

9. The device of claim 3, wherein the adjusting means comprises a bolt threadably engaged with the cross-piece.

* * * * *